US005838346A

United States Patent [19]

Stemmle, Sr.

[11] Patent Number: 5,838,346

[45] Date of Patent: Nov. 17, 1998

[54] SCANNING PRINTHEAD FOR PRINTING ON A MOVING MEDIUM

[75] Inventor: Denis J. Stemmle, Sr., Milford, Conn.

[73] Assignee: Pitney Bowes Inc., Stamford, Conn.

[21] Appl. No.: 717,790

[22] Filed: Sep. 23, 1996

[51] Int. Cl.[6] ..... B41J 23/00

[52] U.S. Cl. ..... 347/37; 347/14; 347/19; 400/615.2

[58] Field of Search ..... 347/14, 16, 19, 347/37, 234, 248, 104, 101; 101/47; 400/282, 615.2, 320, 652; 271/2

[56] References Cited

U.S. PATENT DOCUMENTS 4,890,122 12/1989 Nilsson ..... 346/140

5,144,330 9/1992 Bennett ..... 346/1.1

5,376,958 12/1994 Richtsmeier ..... 347/40

*Primary Examiner*—Edgar S. Burr

*Assistant Examiner*—Dave A. Ghatt

*Attorney, Agent, or Firm*—Angelo N. Chaclas; Melvin J. Scolnick

[57] ABSTRACT

A method of ink jet printing comprising the steps of: (a) conveying a print medium in a first direction; (b) scanning a printhead in the first direction; and (c) printing on the print medium while the printhead is scanning in the first direction and the print medium is moving in the first direction.

18 Claims, 3 Drawing Sheets

SCANNING PRINTHEAD FOR PRINTING ON A MOVING MEDIUM

FIELD OF THE INVENTION

The present invention relates generally to ink jet printers. More particularly, the invention relates to a ink jet printer having a scanning printhead for printing on a moving medium.

BACKGROUND OF THE INVENTION

Ink jet printers are well known in the art. Generally, an ink jet printer includes an array of nozzles or orifices, a supply of ink and a plurality of ejection elements (typically either expanding vapor bubble elements or piezoelectric transducer elements) corresponding to the array of nozzles for ejecting the ink from the nozzles. The ink ejected in the manner forms drops which travel along a flight path until they reach a print medium such as a sheet of paper, overhead transparency, envelope or the like. Once they reach the print medium, the drops dry and collectively form a print image. Typically, the ejection elements are selectively energized so that a predetermined or desired print image is achieved.

Recently, the postage meter industry and other envelope printing industries have begun to incorporate ink jet printers. Generally, the printhead is held stationary while the envelope is fed past. Alternatively, the reverse may be true. The envelope is held stationary and the printhead scans over the envelope. In either type of system, what is important is the relative motion between the printhead and the envelope. A typical postage meter applies evidence of postage, commonly referred to as a postal indicia, to an envelope or other mailpiece and accounts for the value of the postage dispensed. In this manner the dispensing of postal funds is accurately tracked and recorded.

Mailing machines are also well known in the art. The typical mailing machine incorporates a variety of modules for performing different operations on envelopes, such as: singulating, weighing, moistening, sealing, printing postage, accounting for postage and stacking. Thus, the typical mailing machine incorporates a postage meter. However, mailing machines generally only employ postage meters that perform mechanical die printing, sometimes referred to as transfer printing. Although this technology allows for high printing rates, it is mechanically complex and has limited flexibility. For example, changing the graphics design of the postal indicia would require a new die to be manufactured and installed in the postage meter. On the other hand, an ink jet printing postage meter allows for change of the graphics design merely by loading new software.

Those skilled in the art will appreciate that the exact configuration of each mailing machine depends upon the particular needs of each customer. However, two attributes of mailing machines that are important to customers are the number of envelopes processed per hour and the quality of the postal indicia printed on the envelopes. The print quality for ink jet printers is typically described by the number of drops per square inch. Thus, print quality is dependent upon the density of the drops in two directions. The density in a first direction, along the axis of the array of ink jet nozzles, is controlled by the spacing between the nozzles on the printhead (measured in drops per inch (DPI)). However, the density in the other direction, typically transverse to the first direction, is controlled by the firing frequency (measured in drops per second (DPS)) of the nozzles and the relative velocity between the printhead and the envelope. There exists a maximum firing frequency for each type of ink jet printhead which cannot be exceeded for reliable operation of the printhead. This maximum firing frequency limits the number of postal indicias which can be printed with a desired quality per unit of time. For a given maximum firing frequency, a higher relative velocity between the printhead and the envelope can be used to increase throughput. But, this has the negative consequence of increasing the spacing between the drops and diminishing print quality in the direction of envelope travel. It should now be understood that the two attributes of mailing machine that are important to customers, print quality and throughput, work against each other.

To try and solve this problem and provide customers with high throughput mailing machines and high print quality, mailing machine and postage meter manufacturers have sought to obtain printheads having higher density of nozzles and a higher firing rates than what is currently available in the market place. However, these high performance printheads are expensive and drive up the cost of the mailing machine. Generally, customers are reluctant to acceptable this solution.

Another way to solve this problem is to obtain less expensive printheads and compromise both throughput and print quality. This has the benefit of reducing the cost of the mailing machine. Here again, customers are reluctant to accept this solution because reduced throughput increases their operating costs and lower quality printed postal indicias may not be accepted by local postal authorities.

For all of the above reasons, is becomes apparent that there are difficulties in applying conventional ink jet printers to print a quality postal indicia at a high rate of speed in a mailing machine. Therefore, there is a need for a less expensive method of using an ink jet printer to print a quality image on an envelope at a high rate of speed.

SUMMARY OF THE INVENTION

It is an object of the present invention to present a transport apparatus that substantially overcomes the disadvantages and problems associated with the prior art systems.

In accomplishing this and other objects there is provided a method of ink jet printing comprising the steps of: (a) conveying a print medium in a first direction; (b) scanning a printhead in the first direction; and (c) printing on the print medium while the printhead is scanning in the first direction and the print medium is moving in the first direction.

In accomplishing this and other objects there is provided an ink jet printer for printing on a print medium, comprising: means for feeding the print medium in a first direction; means for scanning a printhead in the first direction; and control means in operative communication with the printhead for causing the printhead to print on the print medium while the printhead is scanning in the first direction and the print medium is moving in the first direction.

Additional objects and advantages of the invention will be set forth in the description which follows, and in part will be obvious to those skilled in the art from the description, or may be learned by practice of the invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
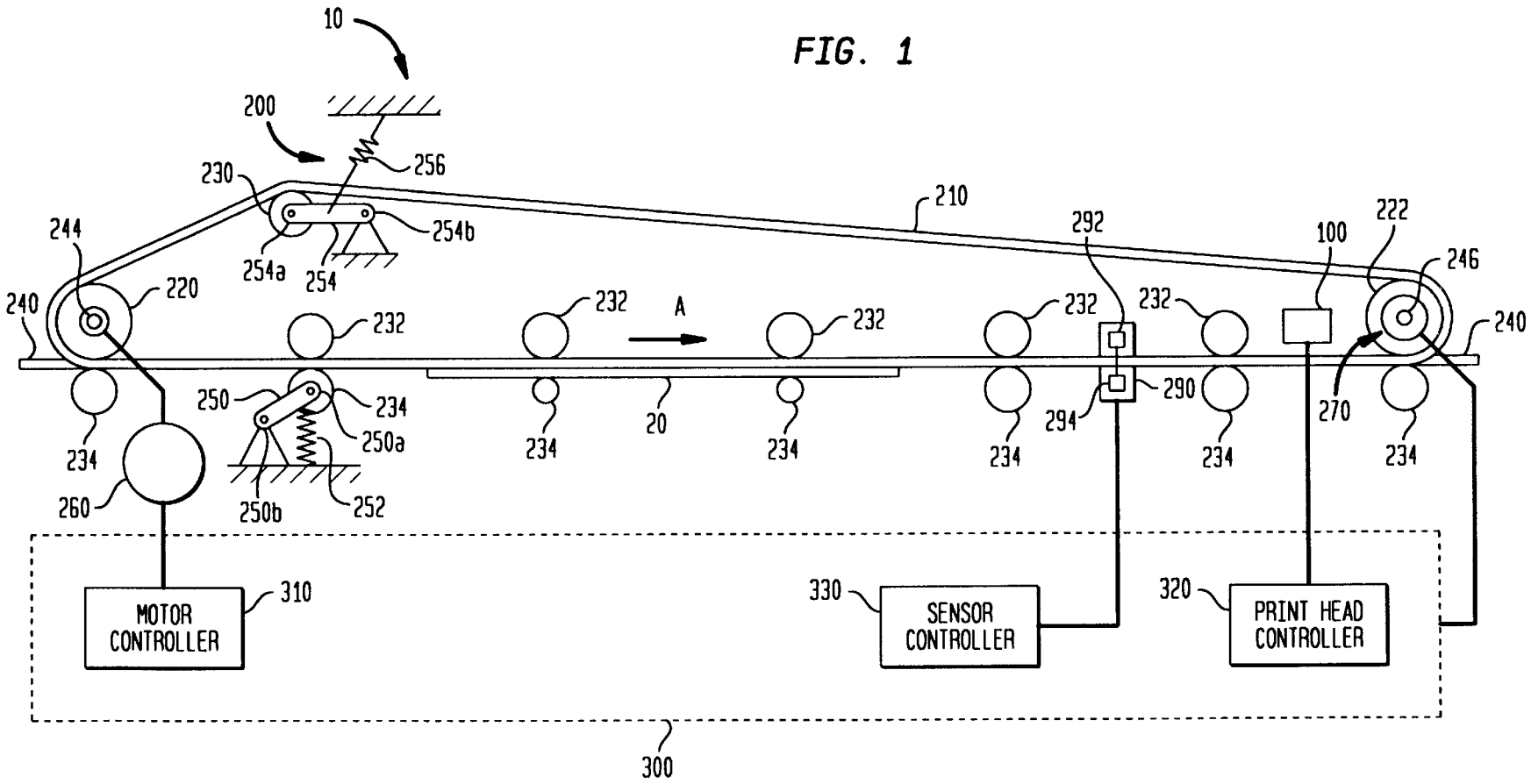
FIG. 1 is a schematic representation of an elevational view of a partial mailing machine including a print module in accordance with the invention.

Referring to FIG. 1, a mailing machine 10 including a print module 100 incorporating the present invention, a transport apparatus 200 and a micro control system 300 is shown. The transport apparatus 200 feeds envelopes in a seriatim fashion in a path of travel along a deck 240 as indicated by arrow A past the print module 100 so that an indicia of postage can be printed on each envelope 20. The print module 100 includes a plurality of ink jet nozzles (not shown) for ejecting droplets of ink in response to appropriate signals. The print module 100 may be of any conventional type such as those commonly available from Hewlett-Packard Company and Canon Inc.

The transport apparatus 200 includes an endless belt 210 looped around a drive pulley 220 and an encoder pulley 222 which is located downstream in the path of travel from the drive pulley 220 and proximate to the print module 100. The drive pulley 220 and the encoder pulley 222 are substantially identical and are fixably mounted to shafts 244 and 246, respectively, which are in turn rotatively mounted to any suitable structure (not shown) such as a frame. The shaft 244 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The transport apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The tensioner pulley 230 is rotatively mounted to one end 254*a* of an arm 254 while the other end 254*b* of the arm 254 is pivotally mounted to any suitable structure (not shown). An extension spring 256 is fixed at one end while the other end is mounted along the span of the arm 254 so as to bias the tensioner pulley 230 outward against the tensioner pulley 230. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively. Each normal force roller 234 is rotatively mounted to one end 250*a* of an arm 250 while the other end of the arm 254 is pivotally mounted to any suitable structure (not shown). For the sake of simplicity, a suitable mounting arrangement is only shown with respect to one of the normal force rollers 234. A compression spring 252 is fixed at one end while the other end is mounted along the span of the arm 250 so as to bias the normal force roller 234 upward and into contact with the endless belt 210.

As described above, the normal force rollers 234 work to bias the envelope 20 is up against the deck 240 which extends along the entire belt plane between the pulleys 220 and 222. This is commonly referred to as top surface registration which is beneficial for ink jet printing. Any variation in thickness of the envelope 20 is taken up by the deflection of the normal force rollers 234. Thus, a constant gap (the distance between the print module 100 and the deck 240) is set between the envelope 20 and the print module 100 no matter what the thickness of the envelope 20. The constant gap is optimally set to a desired value to achieve quality printing. It is important to note that the deck 240 contains suitable openings for the endless belt 210 and normal force rollers 234.

The transport apparatus 200 also includes an encoder system 270 which is located proximate to the print module 100 and operatively coupled to the encoder pulley 222. The encoder system 270 includes an encoder disk (not shown) and an encoder detector (not shown). The function of the encoder system 270 is to provide feedback to the micro control system 300 as to the position of the encoder pulley 222 and thus also the envelope 22. Such encoding systems are well known in the art and no further discussion is necessary for an understanding of the present invention.

The mailing machine 10 also includes an optical sensor module 290 which includes a light emitter 292 and a light receptor 294. The light emitter 292 is located on one side of the deck 240 while the light receptor 294 is located on the other side of the deck 240 so that the envelope 20 passes between the light emitter 292 and the light receptor 294. Thus, when the envelope 20 is present, the light receptor 294 does not receive any light and when the envelope 20 is absent, the light receptor 294 does receive light. In this manner, the sensor module 290 detects the lead and the trailing edge of the envelope 20. Such sensing systems are well known in the art and no further discussion is necessary for an understanding of the present invention.

The micro control system 300 may be of any suitable combination of microprocessors, firmware and software. The micro control system 300 includes a motor controller 310 which is in operative communication with the motor 260, a printhead controller 320 which is in operative communication with the print module 100 and a sensor controller 330 which is in operative communication with the sensor module 290. Additionally, the micro control system 300 is in operative communication with the encoder system 270 via the encoder detector. The micro control system 300 constantly compares the actual position of the envelope 20 with the desired position of the envelope 20 and computes appropriate corrective drive signals which are communicated to the motor controller 310. The motor controller 310 then provides energizing signals to the motor 260 in response to the drive signals received from the micro control system 300. After the sensor module 290 detects the lead edge of the envelope 20, the micro control system 300 initiates a print cycle to be discussed in more detail below.

Additionally, the print module 100 is in communication with the printhead controller 320 which provides energizing signals to the print module 100 in response to instructions from the micro control system 300. As an input, the micro control system 300 receives the feedback information from the encoder detector as the encoder pulley 222 rotates. At selected positions of the envelope 20, the micro control system 300 instructs the printhead controller 320 to energize the print module 100, appropriately. Thus, a line or column of print occurs at selected intervals.

Figure 2:
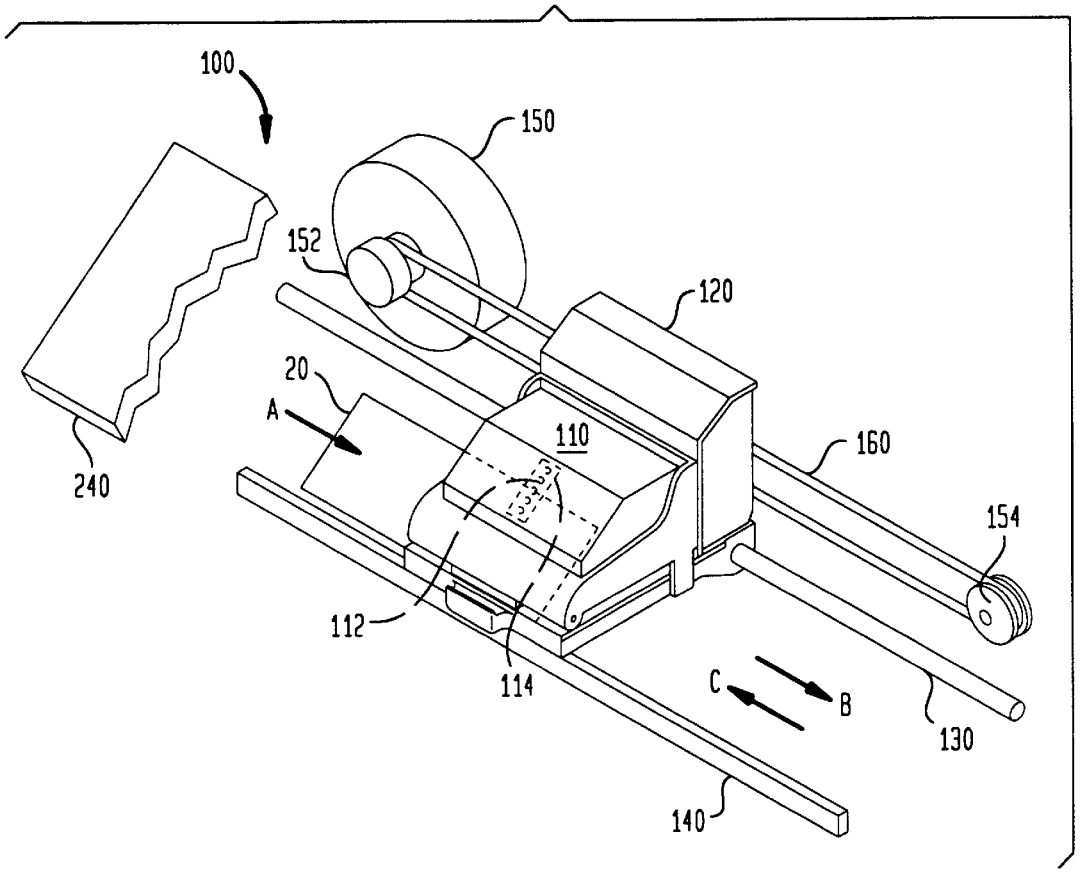
FIG. 2 is an enlarged schematic representation of a perspective view of a print module in accordance with the invention.

Referring to FIG. 2, the print module 100 is shown in more detail. The print module 100 includes a print cartridge 110, a carriage 120 slideably and pivotably mounted at one end to a guide shaft 130 and supported at the other end by a rail 140. The print cartridge 110, detachably mounted to the carriage 120 in any conventional manner, includes a printhead 114 having an array of nozzles 112 and a supply of ink (not shown). The guide shaft 130 and the rail 140 are positioned with respect to the deck 240 (shown cut away for clarity) so that the printhead 114 and nozzles 112 are spaced vertically above and disposed to move in a plane defined by shaft 130 and rail 140 which is substantially parallel to the envelope 20 to define a desired print gap between the nozzles 112 and the envelope 20. The print module 100 further includes a motor 150 having an output shaft 152, a drive belt 160 and a pulley 154. The belt 160 extends between the output shaft 152 and the pulley 154 so that when the motor 150 is energized, the belt 160 advances. The carriage 120 is connected to the belt 160 in any suitable manner (not shown) so that as the belt 160 advances, the carriage 120 scans along guide shaft 130 from left to right and right to left as indicated by arrows B and C, respectively, depending upon the direction of rotation of the output shaft 152.

Figure 4:
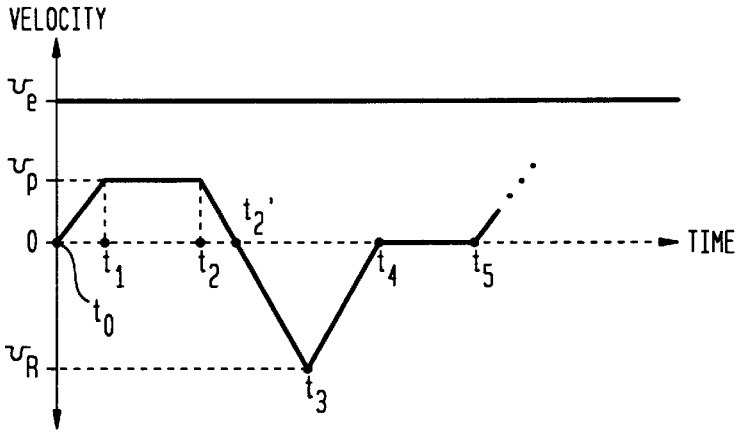
FIG. 4 is a graph showing the velocity of the printhead for the various time intervals shown in FIGS. 3A through 3E of the print cycle in accordance with the invention.
Figure 3A:
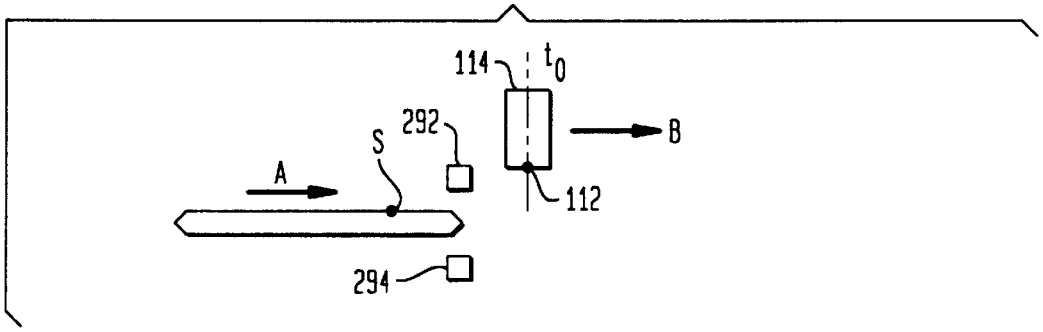
FIGS. 3A through 3E are a sequence of a schematic representations taken at different time intervals of a print cycle in accordance with the invention.
Figure 3B:
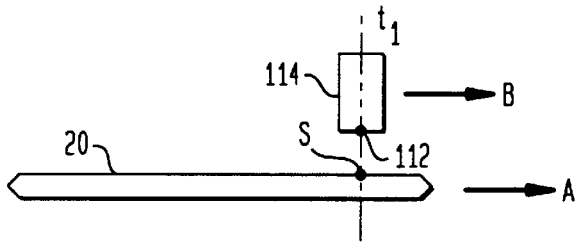
Figure 3C:
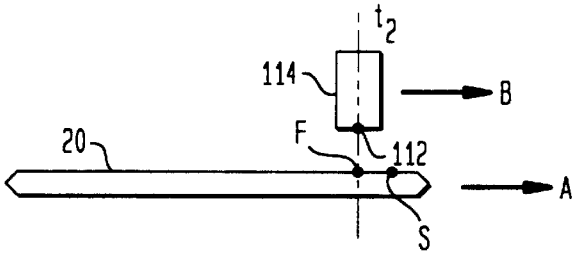
Figure 3D:
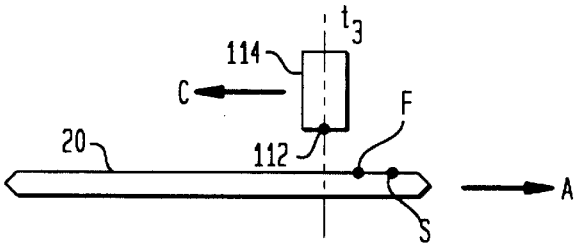
Figure 3E:
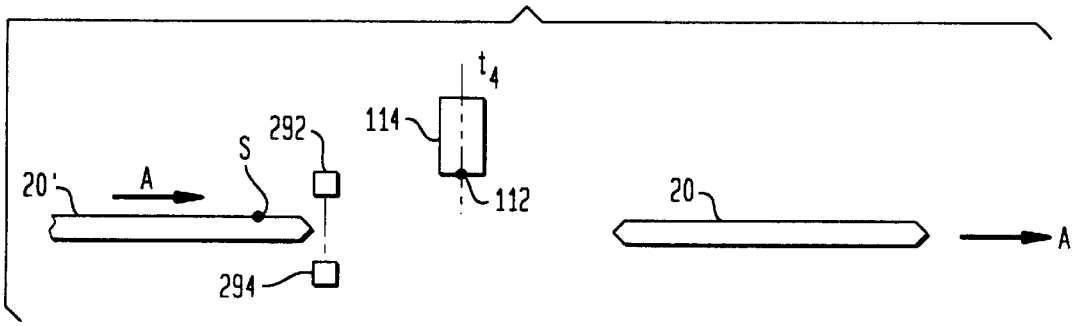

With the structure of the invention described as above, the operational aspects of the invention will now be described with reference to FIGS. 3A through 3E which show a sequence of a schematic representations taken at different time intervals of a print cycle and FIG. 4 which shows a graph of the velocity of the printhead 114 for the various time intervals shown in FIGS. 3A through 3E of the print cycle. During all the time intervals, the envelope 20 is being feed at a predetermined envelope velocity $v_e$ and travels in the direction indicated by the arrow A.

Referring to FIGS. 1, 2, 3A and 4, a time $t_0$ is shown where a point S along the top surface of the envelope 20 is not yet underneath the printhead 114 which is in a home position. The point S represents the position on the envelope 20 where the leading edge of the postal indicia is to be printed. However, the sensor module 290, which is located upstream along the deck 240 from the home position of the printhead 114, has already detected the lead edge of the envelope 20 and the micro control system 300 has initiated the print cycle. The micro control system 300 instructs the motor 150 of the print module 100 to accelerate the printhead 114 away from the home position in the direction shown by arrow B. At time $t_0$, the printhead 114 has not achieve a desired printhead velocity $v_p$ and printing not has yet commenced.

Referring to FIGS. 1, 2, 3B and 4, a time $t_1$ is shown where the point S is underneath the printhead 114 and nozzles 112. Also, the printhead 114 has achieved the desired printhead velocity $v_p$ and printing commences via appropriate signals from the micro control system 300 to the print module 100. Those skilled in the art will recognize that appropriate acceleration profiles for the printhead 114 can be derived based upon: the distance between the sensor module 290 and the home position (which can be set to any suitable dimension), the envelope velocity $v_e$ the desired printhead velocity $v_p$ and the performance characteristics of the motor 150.

Referring to FIGS. 1, 2, 3C and 4, a time $t_2$ is shown where the printhead 114 is still scanning at the desired printhead velocity $v_p$ in the direction indicated by arrow B and printing the postal indicia. A point F along the top surface of the envelope 20, located downstream from point S, is underneath the printhead 114 and represents the end of the postal indicia where printing stops.

Referring to FIGS. 1, 2, 3D and 4, a time $t_3$ is shown where the printhead 114 is scanning in the direction indicated by arrow C and no printing is taking place. At time $t_3$ the printhead 114 is returning back to the home position and reaches a maximum velocity $v_r$ in while returning to the home position. In the time interval between times $t_2$ and $t_3$ the printhead 114 accelerates in the direction indicated by arrow C and changes scanning direction. However, no printing occurs.

Referring to FIGS. 1, 2, 3E and 4, a time $t_4$ the printhead 114 has returned to the home position. Since the lead edge of a subsequent envelope 20' has not yet reach the sensor module 290, the printhead 114 remains stationary until the next print cycle commences. In the time interval between times $t_3$ and $t_4$ the printhead 114 decelerates and comes to rest at the home position.

In the preferred embodiment, it is desired to achieve a print quality or resolution of at least 300 DPI by 300 DPI which yields 90,000 drops per square inch. Therefore, the printhead 114 is selected to have a spacing between the nozzles 112 which is equivalent to at least 300 DPI. Thus, the desired print quality in the direction transverse to the envelope path of travel is automatically met. However, as discussed above, the print quality in the direction of envelope travel is determined by the relative velocity between the printhead 114 and the envelope 20 and the printhead firing rate. For throughput considerations, it is desirable to have the envelope velocity $v_e$ set equal to 40 inches per second (IPS). Generally, printheads 114 are readily available which have a firing rate of 6000 drops per second (DPS). If the printhead 114 were to remain stationary during printing while the envelope 20 was fed past, then the print quality in the direction of envelope travel would be 150 DPI (6000 DPS divided by 40 IPS). However, this would not meet the desired print quality for this direction. Thus, the relative velocity between the envelope 20 and the printhead 114 is reduced by scanning the printhead 114 in the direction of envelope travel during printing. To achieve 300 DPI in the direction of envelope travel, the relative velocity must be 20 IPS (6000 DPS divided by 300 DPI). Therefore, if the envelope velocity $v_e$ is set equal to 40 IPS, then the printhead velocity $v_p$ must be set equal to 20 IPS (40 IPS–20 IPS). Under this arrangement, the desired print quality of 300 DPI by 300 DPI is achieved.

It should be noted that printing at a lower resolution could also be accomplished by holding the printhead 114 in a stationary position while the envelope 20 is fed past the printhead 114 at a high rate for increased throughput. This could be useful in a second mode of operation where high resolution printing is not required, such as: printing ad slogans or reports. Alternatively, high resolution printing is possible with a stationary printhead 114, but that requires that the transport apparatus 200 slow down the envelope 20 during printing. Thus, throughput would be reduced.

It should be appreciated that it is possible to combine these modes of operation. For example, in some applications it is desirable to not only print the postal indicia on the envelope but also an ad slogan, or other communication, selected by the organization originating the envelope 20. In this instance, the length of print along the envelope 20 may be very long. As a result, the length of travel along the shaft 130 for the printhead 114 would have to be correspondingly long to accommodate the entire length of both the postal indicia and the ad slogan. However, this may pose difficulties in being able to return the envelope 20 to the home position in time for a subsequent envelope. Therefore, it is possible to print the postal indicia while the printhead 114 is scanning in the direction of envelope travel, and then, print the ad slogan while the printhead 114 is stationary. This decreases the amount of travel along the shaft 130 for the printhead 114 and facilitates returning the printhead 114 to the home position. This technique would accordingly yield a high resolution postal indicia and a lower resolution ad slogan.

Those skilled in the art will recognize that by only printing when the printhead 114 is at a constant velocity, print quality will be improved. However, it is possible to print during the acceleration and deceleration intervals. Those skilled in the art will also recognize that numerous combinations of different relative velocities and firing rates can be found which will meet a range of desired print qualities. All that is required are simple mathematical calculations as described above once the performance specifications of the printhead 114 have been identified.

Many features of the preferred embodiment represent design choices selected to best exploit the inventive concept as implemented in a mailing machine with a transport apparatus 200 for feeding the envelope 20 and printing a postal indicia. Those skilled in the art will recognize that this invention may find application in other industries where the need for quality printing exists. For example, other methods of digital printing, such as direct thermal or thermal transfer, could benefit in a similar fashion from the inventive concepts described above.

Moreover, additional advantages than those described above and various modifications will readily occur to those skilled in the art. Therefore, the inventive concept in its broader aspects is not limited to the specific details of the preferred embodiment but is defined by the appended claims and their equivalents.

What is claimed is:

1. A method of ink jet printing comprising the steps of:

conveying a print medium in a first direction;

scanning a printhead in the first direction; and printing on the print medium while the printhead is scanning in the first direction and the print medium is moving in the first direction.

2. The method of claim 1, wherein:

the conveying step includes the step of:

conveying the print medium at a first velocity; and the scanning step includes the step of:

scanning the printhead at a second velocity which is less than the first velocity; and the printing step includes the step of:

printing on the print medium while the printhead is scanning at the second velocity and the print medium is moving at the first velocity.

3. The method of claim 2, further comprising the step(s) of:

accelerating the printhead from a stationary home position to the second velocity; and after the printing step, decelerating the printhead from the second velocity.

4. The method of claim 3, further comprising the step(s) of:

returning the printhead to the home position.

5. The method of claim 1, further comprising the step(s) of:

printing on the print medium while the printhead is stationary and the print medium is moving in the first direction.

6. The method of claim 5, wherein:

the conveying step includes the step of:

conveying the print medium at a first velocity; and the scanning step includes the step of:

scanning the printhead at a second velocity which is less than the first velocity; and the printing while scanning step includes the step of:

printing on the print medium while the printhead is scanning at the second velocity and the print medium is moving at the first velocity.

7. The method of claim 6, further comprising the step(s) of:

accelerating the printhead from a stationary home position to the second velocity; and after the printing while scanning step, decelerating the printhead from the second velocity.

8. The method of claim 7, further comprising the step(s) of:

returning the printhead to the home position.

9. The method of claim 8, wherein:

the step of printing while the printhead is scanning occurs before the step of printing while the printhead is stationary.

10. An ink jet printer for printing on a print medium, comprising:

means for feeding the print medium in a first direction;

means for scanning a printhead in the first direction; and control means in operative communication with the printhead for causing the printhead to print on the print medium while the printhead is scanning in the first direction and the print medium is moving in the first direction.

11. The printer of claim 10, wherein:

the feeding means feeds the print medium at a first velocity;

the scanning means scans the printhead at a second velocity which is less than the first velocity; and the control means causes printing on the print medium while the printhead is scanning at the second velocity and the print medium is moving at the first velocity.

12. The printer of claim 11, wherein:

the scanning means accelerates the printhead from a stationary home position to the second velocity before printing; and the scanning means decelerates the printhead from the second velocity after printing.

13. The printer of claim 12, wherein:

the scanning means returns the printhead to the home position before commencing printing on a subsequent print medium.

14. The printer of claim 10, wherein:

the control means causing the printhead to print on the print medium while the printhead is stationary and the print medium is moving in the first direction.

15. The printer of claim 14, wherein:

the feeding means feeds the print medium at a first velocity;

the scanning means scans the printhead at a second velocity which is less than the first velocity; and the control means causes printing on the print medium while the printhead is scanning at the second velocity and the print medium is moving at the first velocity.

16. The printer of claim 15, wherein:

the scanning means accelerates the printhead from a stationary home position to the second velocity before printing; and the scanning means decelerates the printhead from the second velocity after printing while scanning.

17. The printer of claim 16, wherein:

the scanning means returns the printhead to the home position before commencing printing on a subsequent print medium.

18. The printer of claim 17, wherein:

the control means causes printing while scanning before printing while the printhead is stationary.

* * * * *